United States Patent [19]

Huldén

[11] Patent Number: 4,944,628

[45] Date of Patent: Jul. 31, 1990

[54] QUICK COUPLING MEANS FOR A WORKING IMPLEMENT OF AN EXCAVATING MACHINE

[76] Inventor: Fritiof Huldén, Pl 3155,S-660 60, Molkom, Sweden

[21] Appl. No.: 378,190

[22] PCT Filed: Jan. 22, 1988

[86] PCT No.: PCT/SE88/00020

§ 371 Date: Jun. 28, 1989

§ 102(e) Date: Jun. 28, 1989

[87] PCT Pub. No.: WO88/05847

PCT Pub. Date: Aug. 11, 1988

[30] Foreign Application Priority Data

Jan. 28, 1987 [SE] Sweden ..... 8700319

[51] Int. Cl.[5] ..... F16B 1/00

[52] U.S. Cl. ..... 403/24; 403/322; 37/117.5; 414/723; 172/272

[58] Field of Search ..... 414/723, 724, 686; 37/103, 117.5; 172/272, 273, 274; 403/24, 322

[56] References Cited

U.S. PATENT DOCUMENTS 4,663,866 5/1987 Karlssoy ..... 414/723 X 4,881,867 11/1989 Essex ..... 403/322

*Primary Examiner*—Andrew V. Kundrat

*Attorney, Agent, or Firm*—Nixon & Vanderhye

[57] ABSTRACT

A coupling means for detachably coupling a working implement to the operating arm of an excavating machine, said implement having an upper surface facing the operating arm, said coupling means comprising a first attachment member which is rigidly mounted to the upper surface of the implement and comprises a coupling element, and a second attachment member supported by the operating arm stick and operating cylinder via horizontal, parallel shafts and comprising a coupling element consisting of two locking parts arranged movable in relation to each other to be brought into locking engagement with the coupling element of the first attachment member by means of a power-generating means, said coupling elements having cooperating engagement surfaces which when the attachment members are connected together, are located in a common reference plane which is perpendicular to a common central plane for a stick and operating cylinder. In accordance with the invention all engagement surfaces of the two coupling elements have a circle arc-shaped extension in said reference plane and have the same radius.

15 Claims, 7 Drawing Sheets

7
6
10
46
9
19
46
8
47
12
15
28
22
26
3
27
11
16
13
45
2
14
17
25
24
21
4
1
5

QUICK COUPLING MEANS FOR A WORKING IMPLEMENT OF AN EXCAVATING MACHINE

The present invention relates to a coupling means for detachably coupling a working implement to the operating arm of an excavating machine, said implement having an upper surface facing the operating arm, said coupling means comprising a first attachment member which is rigidly mounted to the upper surface of the implement and comprises a coupling element, and a second attachment member supported by the operating arm stick and operating cylinder via horizontal, parallel shafts and comprising a coupling element consisting of two locking parts arranged movable in relation to each other to be brought into locking engagement with the coupling element of the first attachment member by means of a power-generating means, said coupling elements having cooperating engagement surfaces which, when the attachment members are connected together, are located in a common reference plane which is perpendicular to a common central plane for the stick and operating cylinder.

The object of the present invention is to provide an improved coupling means which allows the attachment members to be connected in such a manner that the working implement can assume at least two different positions in relation to the operating arm and which, besides a friction joint, provides a form joint which prevents the attachment members from being displaced laterally in relation to each other in the common plane of the attachment members, either in connected position or when the friction joint has been released or not yet been brought into operation, while the coupling element of the operating arm is in loose but not separable engagement with the coupling element of the implement.

It is a further object of the present invention to provide a coupling means enabling the attachment members to be connected without the implement and its attachment members having to be placed and aligned to each other in any special coupling position.

A still further object of the present invention is to provide a coupling means enabling the attachment members to be connected in such a manner that the working implement can assume an unlimited number of different positions in relation to the operating arm.

A further object of the present invention is to provide a coupling means enabling the implement to be turned in relation to the operating arm while the attachment members are in loose but inseparable engagement with each other. The implement can thus be connected to the operating arm irrespective of how it is placed on the ground. A first connection can thus be achieved immediately, after which the implement can be moved closer to the excavator or to a more suitable place in front of this machine. If the friction joint is released but the form joint retained, the implement can be turned in relation to the attachment members of the operating arm, until the implement assumes the correct position for the work desired. This turning movement is enabled by a lower corner of the implement being brought into abutment with a suitable counter support on the ground. During excavation work, for instance, the implement can thus be directed in a different direction, thereby making more expedient use thereof for a specific task, e.g. excavating or levelling out material laterally.

A further object of the present invention is to provide a coupling means having an attachment member for the implement so designed that it can be welded onto the implement without time-consuming and accurate alignment of the coupling means.

The above mentioned objects are achieved by the coupling means according to the present invention which is substantially characterised in that all engagement surfaces of said two coupling elements have a circle arc-shaped extension in said reference plane and have the same radius.

In the most preferred embodiment of the invention the engagement surfaces are arranged in relation to each other in such a manner that they have the same centre when the attachment members are connected together.

Additional features, advantages and objects of the invention will be apparent from the following description and claims.

The invention will be described further in the following, with reference to the accompanying drawings.

Figure 1:
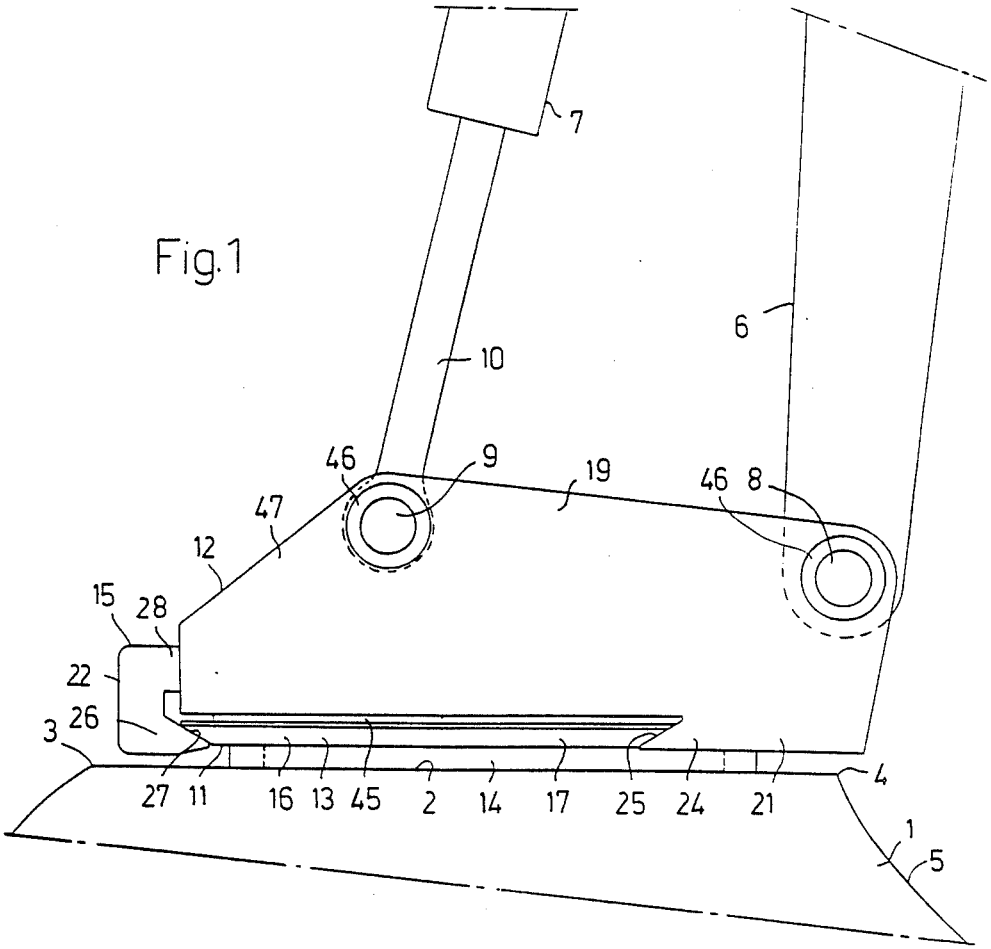
FIG. 1 shows schematically parts of a bucket and operating arm of an excavating machine seen from the side, the bucket being pivotably and controlably journalled to the operating arm via a coupling means according to a first embodiment of the present invention.
Figure 2:
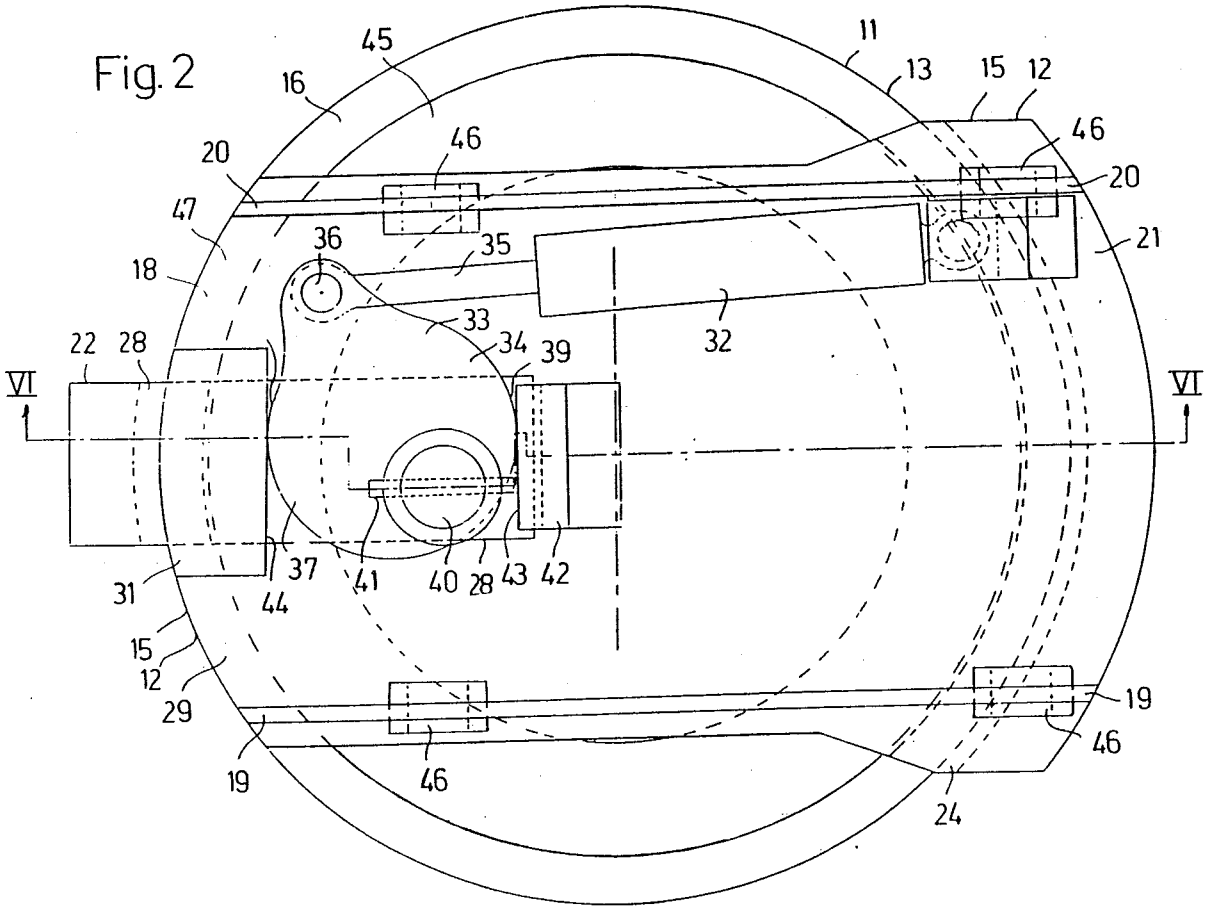
FIG. 2 is a plan view of the coupling means according to FIG. 1 with its two attachment members connected together.

With reference to FIG. 1, it is shown therein in a side view a working implement in the form of a bucket 1 for an excavating machine. The bucket has a flat top portion 2 with a rear edge 3 and a front edge 4 which is close to the bucket opening 5. The operating arm of the excavator comprises a stick 6 and a hydraulic operating cylinder 7 arranged on the front side of the operating arm (the side facing away from the excavator). The stick 6 is provided with a horizontal bolt or shaft 8 at its lower, free end. Similarly, the hydraulic operating cylinder 7 is provided at its lower free end with a horizontal bolt or shaft 9 which is parallel to the shaft 8 of the stick 6 and is located in front of this.

The operating arm 6, 7 of the excavator and the bucket 1 are connected to each other by a coupling means in the form of a quick coupling in accordance with the present invention. The bucket is pivotably supported by the shaft 8 of the stick 6 and this shaft thus forms the pivoting centre of the bucket. A controlled pivoting movement of the bucket about the shaft 8 of the stick 6 is obtained with the aid of the hydraulic operating cylinder 7.

In the embodiment shown the hydraulic operating cylinder 7 is journalled directly at the quick coupling by its piston rod 10 via the shaft 9. Alternatively this journalling can be effected indirectly with the aid of intermediate links.

The quick coupling according to the invention comprises a first attachment member 11 for the bucket 1 and a second attachment member 12 for the operating arm. The attachment member 11 comprises a coupling element 13 and a distance element 14, by means of which the attachment member 11 is welded to the flat top portion 2 of the bucket 1. In the embodiment shown the distance element 14 is in the form of a ring. The ring 14 and coupling element 13 are rigidly connected to each other to form a rigid unit. In the embodiment shown, the coupling element is in the form of a flat, circular plate provided on the upper side facing away from the ring 14, with a flat support element 45 which may consist of a single circular piece or of several arc-shaped pieces, so-called shims. Alternatively, the coupling element may be in the form of a flat, relatively wide ring. The plate 13 (or alternatively the ring) has a circular engagement portion 16 with, in relation to the plane of the plate, an inclined, outwardly directed, circular engagement surface 17 having a predetermined radius. The engagement surface 17 faces downwards, i.e. towards the top portion 2 of the bucket 1. The engagement surface 17 and the plane envelope an acute angle which can vary in size in a wide range and is preferably between 20° and 60°, most preferably between 25° and 35°.

Figure 3:
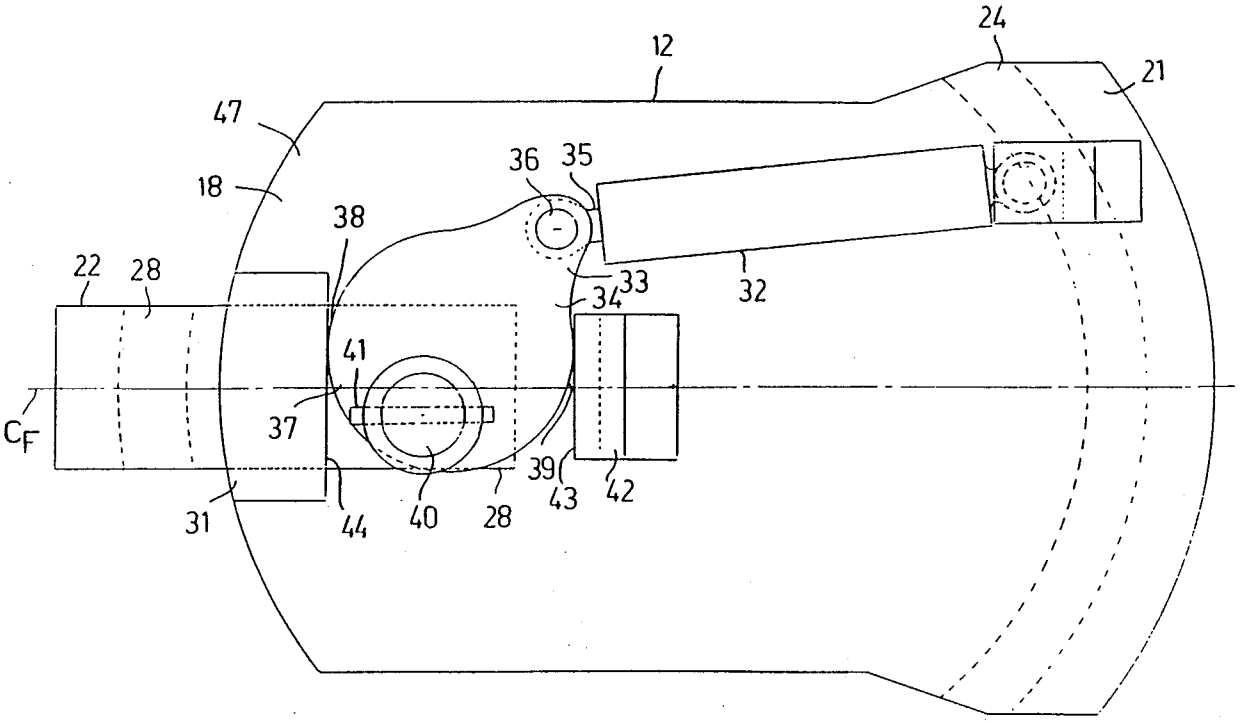
FIG. 3 shows the operating arm attachment member in a top view with the upper side pieces removed for the sake of clarity.

The attachment member 12 for the operating arm comprises a connecting element 47 forming a rigid body and having substantially U-shaped cross section. The connecting element is formed of a bottom plate 18 and two side pieces 19, 20 spaced a predetermined distance apart. The distance between the side pieces 19, 20 is determined by the width of the stick 6 at its lower end, and the side pieces are provided with axially aligned bushings 46 through which the shafts 8 and 9 pass and in which they are journalled. The side pieces 19, 20 with bushings 46 are normally welded in place but have been removed in FIG. 3 for the sake of clarity. The connecting element 47 is symmetrical with respect to its vertical central plane $C_F$ (FIG. 3). The attachment member 12 also includes a coupling element 15 consisting of two locking parts 21, 22 located at a distance from and opposite each other. The locking parts 21, 22 are movable in relation to each other in order to be brought into locking engagement with the coupling element 13 of the first attachment member 11. One of the locking parts is preferably stationary in relation to the connecting element 47 whereas the other is movable, thus forming a stationary locking part 21 and a movable locking device 22. The locking part 21 and locking device 22 are diametrically aligned and symmetrical with respect to the central plane $C_F$ of the connecting element 47. The stationary locking part 21 of the coupling element 15 is arranged on the side of the connecting element 47 which is located below the shaft 8 of stick 6. The locking part 21 is rigidly secured to the bottom plate 18 and extends at its lower side 23. It is provided with an engagement portion 24 with an engagement surface 25 facing inwardly and inclined with respect to the bottom plate 18. The engagement portion 24 and its engagement surface 25 have circle arc-shaped extension and encompass a sector angle of about 90° in the embodiment shown.

The locking device 22 located diametrically in relation to the engagement portion 24 (or the locking part 21) is provided with an engagement portion 26 located on the lower side of the bottom plate 18 and having an inwardly directed engagement surface 27 which is inclined in relation to the bottom plate 18. The engagement portion 26 and its engagement surface 27 also have circle arc-shaped extension and encompass a sector angle less than that of the engagement portion 24 and its engagement surface 25, e.g. 20°. The engagement surfaces 25, 27 of the locking element 21 and locking device 22 have the same predetermined radius. This radius agrees with the radius of the engagement surface 17 of plate 13. The engagement surfaces 25, 27 form an acute angle with the plane of the bottom plate 18, this angle lying within the ranges stated for the engagement surface 17 of plate 13. In order to achieve the best possible friction joint, the angles of engagement surfaces 17, 25 and 27 are the same in each specific case. The locking device 22 is provided with a straight, upper plate 28 which is arranged to rest on the upper side 29 of the bottom plate 18 of the connecting element 47 and which is connected to the engagement portion 26 to form a unitary piece with this. The locking device 22 is arranged to be moved in a rectilinear path coinciding with the centre line of the connecting element 47, the movement occurring in sliding contact with the upper side 29 of the bottom plate 18, between an outer, free-running position and an inner, locking position in relation to the engagement surface 27 of the plate 13. The locking device 22 is guided by a support 31 welded adjacent to the edge region of the upper side 29 of the bottom plate 18, said support having a rectangular opening somewhat larger than the cross section of the plate 28 to allow it to move to and fro. The movement of the locking device 22 is effected by means of a power-generating means 32 via a specially designed link mechanism 33. The power-generating means in the example shown consists of a hydraulic cylinder attached by its rear end to the bottom plate 28 inside the position for the counter part 21 and close to the side piece 20. The link mechanism 33 comprises a pressure cam 34 which is rotably connected to the piston rod 35 of the hydraulic cylinder 32 via a vertical pin 36. The pressure cam 34 is drop-shaped, the larger circular part 37 thereof having opposing vertical circle arc-shaped support surfaces 38, 39. The pressure cam 34 is pivotably connected to the plate 28 of the locking device 22 by means of a vertical pin 40 which is held in position by a locking pin 41. At the free end of the plate 28 there is a support 42 with a vertical, transverse, straight support surface 43 located parallel to a corresponding vertical, transverse, straight support surface 44 of the support 31. The opposing support surfaces of the circular portion 37 of the pressure cam 34 press alternately against the support surface 44 of the support 31 and the support surface 43 of the support 42 when the locking device 22 is moved into the locking position and out to the free-running position, respectively. By the action of the hydraulic cylinder 32 the pressure cam 34 constantly exerts pressure on the support surface 44 of the support 31 when the locking device 22 and the locking part 21 functioning as counter member are in engagement with the Coupling element 13, a firm and play-free joint is ensured and braking forces and other forces occurring in the bucket during the work will be transferred to the stick 6 via the coupling element 13, locking element 21, locking device 22, link mechanism 33, support 31, connecting element 47 and stick shaft 8.

To prevent the coupling grip from being completely lost if a fault occurs in the hydraulic system serving the hydraulic cylinder 32, a special safety device is arranged to ensure that attachment members 11, 12 cannot become separated from each other when such a fault occurs. Such a safety device is then served by a drive system other than said hydraulic system. The plate 28 may be provided with an inner shoulder for a catch, for instance, which in safety position acts between the shoulder and support 31. The catch forms the free end of a lever pivotably journalled on the bottom plate 18, said lever being constantly forced by a spring into the safety position. The other end of the lever is actuated by a hydraulic cylinder or some other power-transmitting means in a drive system separate from the main drive system of the machine serving the hydraulic cylinder 32. It is therefore an advantage to have a small space between said shoulder and catch so that the locking device 22 can be moved radially outwards from the plate 13 a short distance, corresponding to said space, with the aid of the hydraulic cylinder 32 so that the friction joint is released but a structural joint is still maintained, i.e. the attachment members cannot be separated from each other as will be described further below. When the friction joint is no longer in function, but the form joint is still maintained, it is then possible to turn the attachment members in relation to each other, whereby the safety device thus guarantees that the attachment members are not separated from each other.

Figure 6:
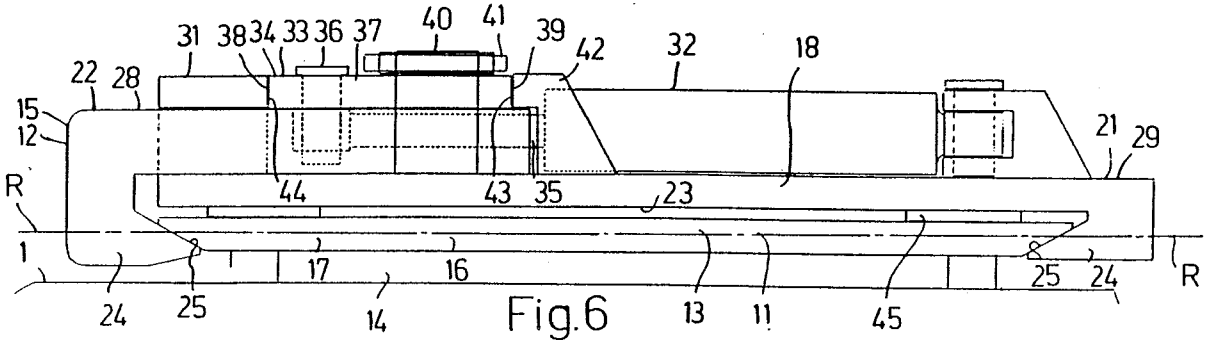
FIG. 6 is a cross section of the attachment members along the line VI—VI in FIG. 2.
Figure 5:
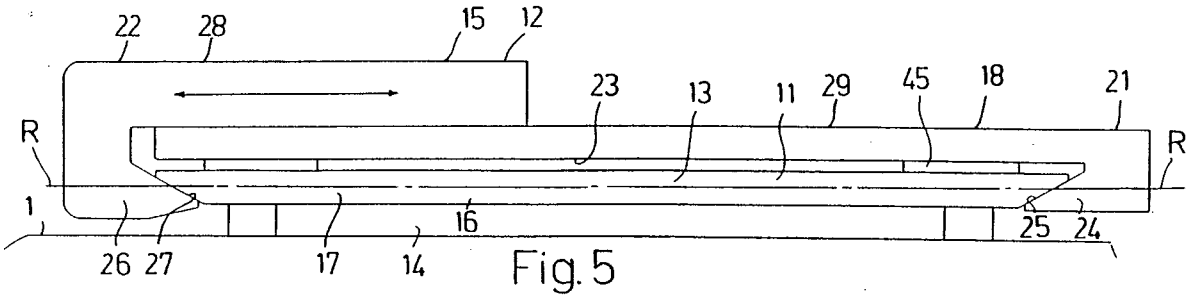
FIG. 5 shows parts of the two attachment members of the coupling means when connected together.
Figure 4:
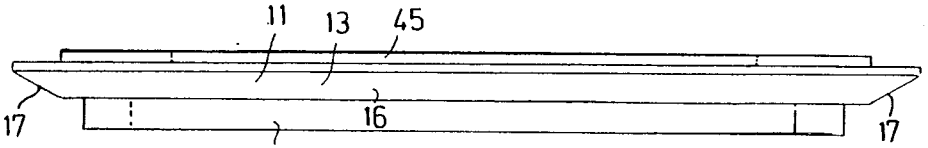
FIG. 4 shows the bucket attachment member seen from the side.

In FIGS. 5 and 6 a reference plane is designated with the letter R. This plane extends through the two coupling elements 13, 15 when connected, the engagement surfaces 17, 25, 27 thus being pressed together to form a maximum friction joint. This reference plane R is thus parallel to the bottom plate 18 and plate 13, and said angles of inclination for the engagement surfaces 17, 25, 27 are also applicable to said reference plane R. All engagement surfaces 17, 25, 27 are arranged so that they have a circle arc-shaped extension in said reference plane and, as mentioned earlier, thus have the same radius. In the embodiment shown, the engagement surface 17 of coupling element 13 has maximum extension, i.e. 360°. Since the engagement surface 17 has circular extension, i.e. maximum circle arc-shaped extension, all the engagement surfaces 17, 25, 27 of the two coupling elements 13, 15 will have the same centre when the attachment members 11, 12 are connected together. By way of clarification it would be noted that said reference plane R is perpendicular to a common central plane through the stick 6 and operating cylinder 7. This central plane thus coincides with the central plane $C_F$ of the attachment member 12 or connecting element 47 (FIG. 3).

The shown attachment members 11, 12 are designed to be connected in such a manner that the bucket can assume different positions in relation to the operating arm. Since the attachment member 11 is provided with a plate 13 with circular engagement portion 16, the bucket 1 can assume an unlimited number of different positions for the coupling. Furthermore, the attachment member 11 can be mounted on the bucket without the need for accurate measurements to ensure that the engagement surfaces are aligned and located at predetermined points in relation to each other and to the side edges of the bucket.

The oblique, cooperating engagement surfaces 17, 25, 27 provide a friction joint with wedge action when the locking device 22 is brought into locking position. Inclined engagement surfaces are therefore preferred. The circular or circle arc-shaped extension of the inclined engagement surfaces 17, 25, 27 in turn ensures that a form joint is obtained, preventing the attachment members 11, 12 from being displaced laterally in relation to each other in said reference plane R and perpendicularly to said central plane $C_F$ of the attachment member 12. This form joint is thus maintained not only when the locking device 22 is in locking position but also when this has been loosened somewhat, i.e. when the locking device 22 and locking part 21 are in loose but not separable engagement with the bucket plate 13. While retaining this form joint, the bucket 1 can now be moved in relation to the stick 6 until the bucket has assumed the correct position for the work desired. This turning and re-adjustment of the bucket can also be performed during actual excavation in order to move the bucket to a new position suitable for a specific work, i.e. excavating or levelling out material in lateral direction. During this turning movement a lower corner of the bucket is brought into abutment with a suitable support on the ground.

The circle arc-shaped extension of the engagement portions 24 and 26 may vary. In general they may each encompass a sector angle of up to about 175°. However, this provides an undesired weight increase of the coupling. The wider the engagement portions, the better will be the engagement of coupling. A compromise must therefore be made. A preferred sector angle for the engagement portion 24 is about 90°–100° and for the engagement portion 26 about 20°–35°.

Figure 7:
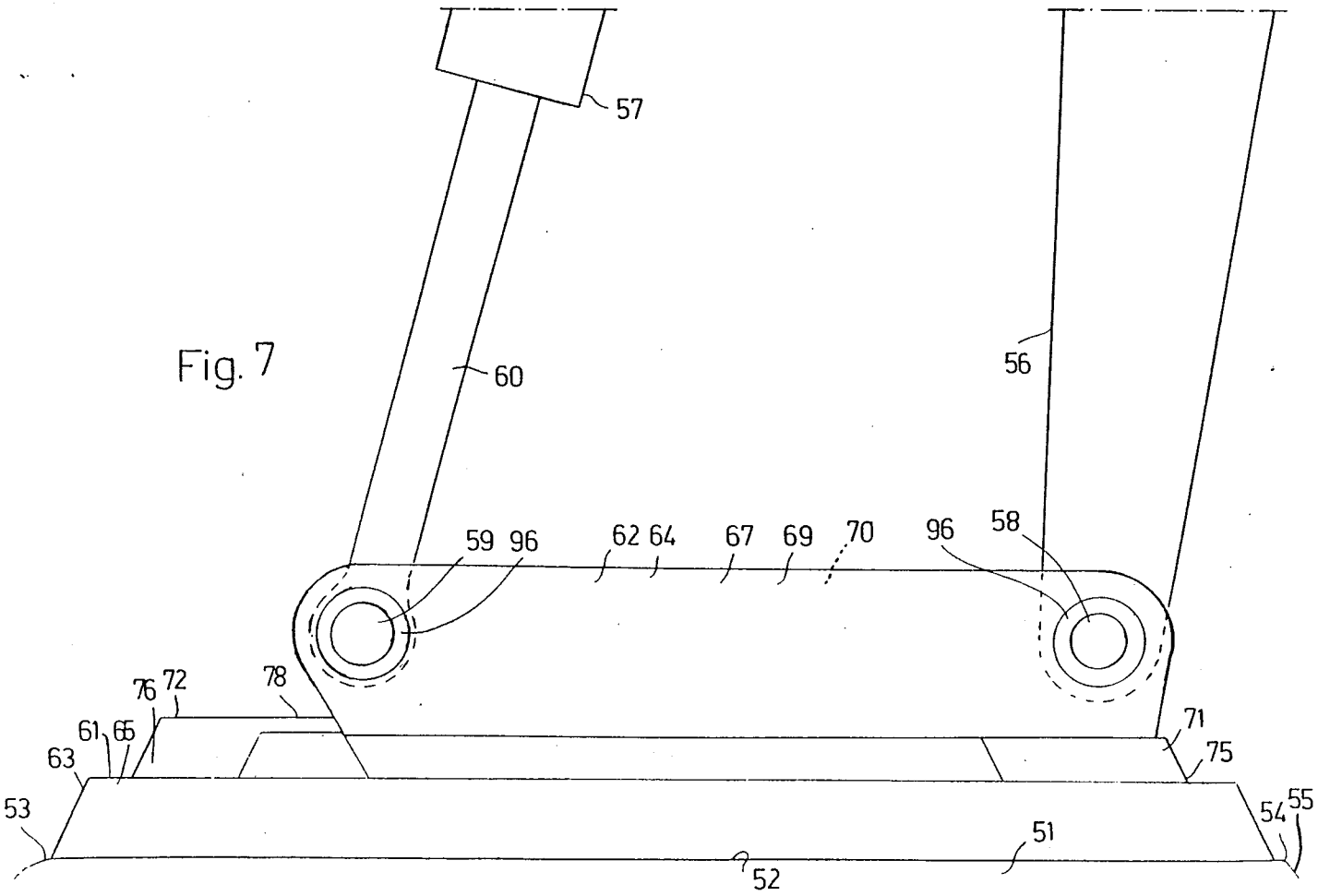
FIG. 7 shows schematically parts of a bucket and operating arm of an excavating machine seen from the side, the bucket being pivotably and controlably journalled to the operating arm via a coupling means according to a second embodiment of the present invention.

In FIGS. 7–11 it is shown another embodiment of a coupling means according to the present invention. With reference to FIG. 7 it is shown in a side view a working implement in the form of a bucket 51 for an excavator, the bucket having a flat top portion 52 with a rear edge 53 and front edge 54 which is close to the bucket opening 55. The operating arm of the excavator comprises a stick 56 and a hydraulic operating cylinder 57 arranged on the front side of the operating arm (the side facing away from the excavator). The stick 56 is provided with a horizontal bolt or shaft 58 at its lower, free end. Similarly, the hydraulic operating cylinder 57 is provided at its lower free end with a horizontal bolt or shaft 59 which is parallel to the shaft 58 of stick 56 and is located in front of this.

The operating arm 56, 57 of the excavator, and the bucket 51, are connected to each other by a coupling means in the form of a quick coupling in accordance with a second embodiment of the present invention. The bucket is pivotably supported by the shaft 58 of the stick 56 and this shaft thus forms the pivoting centre of the bucket. A controlled pivoting movement of the bucket about the shaft 58 of stick 56 is obtained with the aid of the hydraulic operating cylinder 57.

In the embodiment shown the hydraulic operating cylinder 57 is journalled directly at the quick coupling by its piston rod 60 via the shaft 59. Alternatively this journalling can be effected indirectly with the aid of intermediate links.

The quick coupling according to this second embodiment of the invention also comprises a first attachment member 61 for the bucket 51 and a second attachment member 62 for the operating arm. The attachment member 61 comprises a coupling element 63 which, in the embodiment shown, is in the form of a ring with a V-shaped cross section. The ring has a flat mounting portion 83 by means of which the coupling element 63 is welded to the flat top portion 52 of the bucket 51, and an upwardly directed engagement portion 65 having an inwardly directed, inclined, circular engagement surface 66 with a predetermined radius. The engagement surface 66 faces downwards, i.e. towards the top portion 52 of the bucket 51, an acute angle being formed between the engagement surface 66 and the plane of the ring 63, said angle varying in size in a wide range but being preferably between 40° and 80°.

Figure 8:
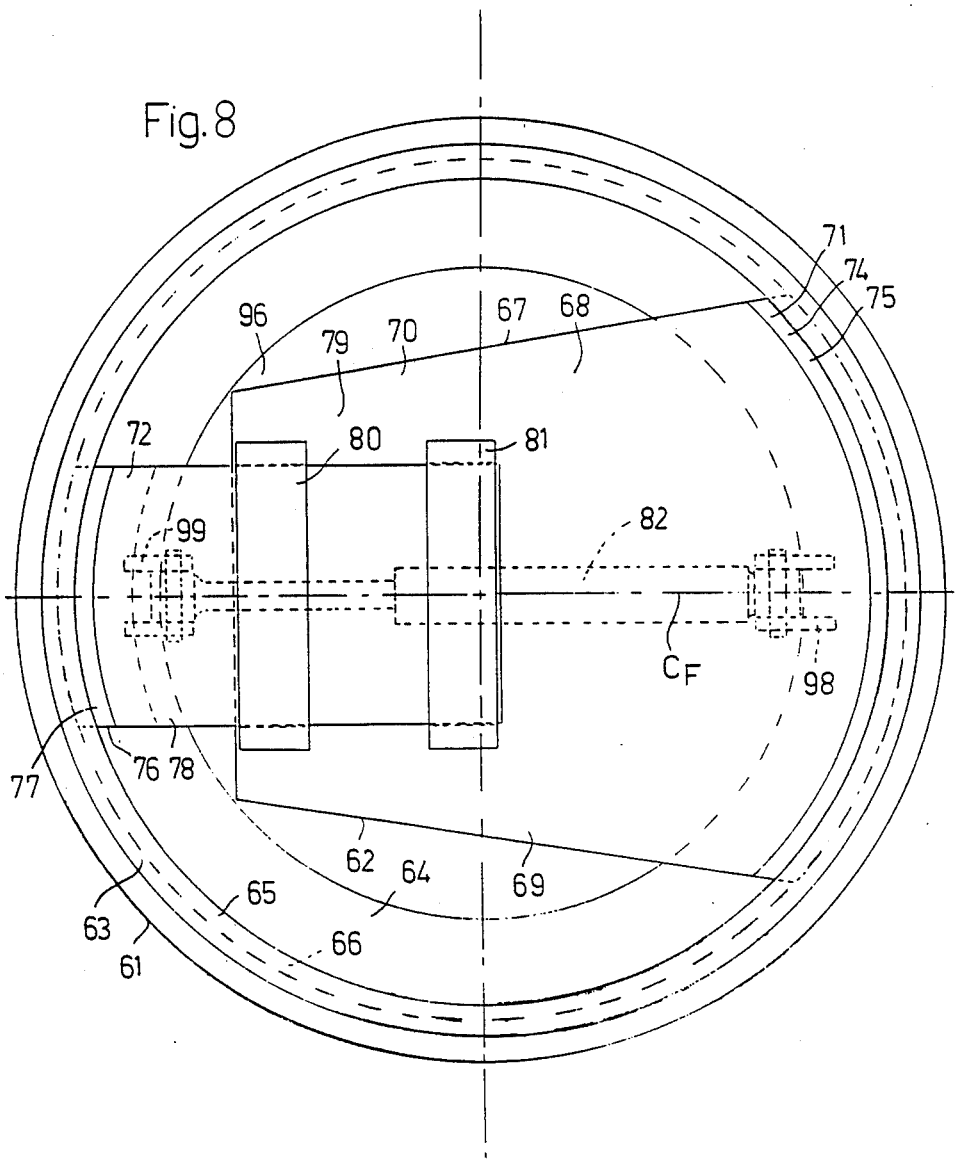
FIG. 8 is a plan view of the coupling means according to FIG. 7 with its two attachement members connected together.
Figure 11:
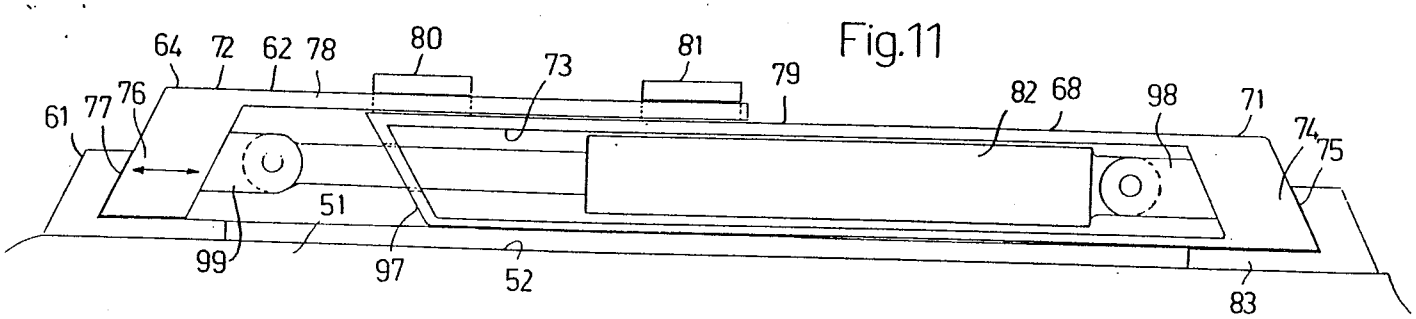
FIG. 11 is a central cross section through the attachment members according to FIG. 8.

The attachment member 62 for the operating arm comprises a connecting element 67 forming a rigid body and having substantially U-shaped cross section. The connecting element is formed of a bottom plate 68 and two side pieces 69, 70 spaced a predetermined distance apart. The distance between the side pieces 69, 70 is determined by the width of the stick at its lower end, and the side pieces are provided with axially aligned bushings 96 through which the shafts 58 and 59 pass and in which they are journalled. The side pieces 69, 70 with bushings 96 are normally welded in place but have been removed in FIG. 8 for the sake of clarity. The connecting element 67 is symmetrical with respect to its vertical central plane $C_F$ (FIG. 8). The attachment member 62 also includes a coupling element 64 consisting of two locking parts 71, 72 located at a distance from and opposite each other. The locking parts 71, 72 are movable in relation to each other in order to be brought into locking engagement with the coupling element 63 of the first attachment member 61. One of the locking parts is preferably stationary in relation to the connecting element 67 whereas the other is movable, thus forming a stationary locking part 71 and a movable locking device 72. The locking part 71 and locking device 72 are diametrically aligned and symmetrical with respect to the central plane $C_F$ of the connecting element 67. The stationary locking part 71 of the coupling element 64 is arranged on the side of the connecting element 67 which is located below the shaft 58 of stick 56. The locking part 71 is rigidly secured to the bottom plate 68 and extends peripherally in the direction downwards. It is provided with an engagement portion 74 with an engagement surface 75 facing outwardly and inclined with respect to the bottom plate 68. The engagement portion 74 and its engagement surface 75 have circle arc-shaped extension and encompass a sector angle of about 90° in the embodiment shown.

The locking device 72 located diametrically in relation to the engagement portion 74 (or the locking part 71) is provided with an engagement portion 76 located at a level under the bottom plate 68 and having an outwardly directed engagement surface 77 which is inclined in relation to the bottom plate 68. The engagement portion 76 and its engagement surface 77 also have circle arc-shaped extension and encompass a sector angle less than that of the engagement portion 74 and its engagement surface 75, e.g. 30°. The engagement surfaces 75, 77 of the locking element 71 and locking device 72 have the same predetermined radius. This radius agrees with the radius of the engagement surface 66 of engagement portion 65. The engagement surfaces 75, 77 form an acute angle with the plane of the bottom plate 68, this angle lying within the ranges stated for the engagement surface 66 of engagement portion 65. In order to achieve the best possible friction joint, the angles of engagement surfaces 66, 75 and 77 are the same in each individual case. The locking device 72 is provided with a straight, upper plate 78 which is arranged to rest on the upper side 79 of the bottom plate 68 of the connecting element 67 and which is connected to the engagement portion 76 to form a unitary piece with this. The locking device 72 is arranged to be moved in a rectilinear path coinciding with the centre line of the connecting element 67, the movement occurring in sliding contact with the upper side 79 of the bottom plate 68, between an inner, free-running position and an outer, locking position. The locking device 72 is guided in two supports 80, 81, welded one adjacent to the edge region of the upper side 79 of the bottom plate 68, and the other at a distance therefrom. The supports 80, 81 have rectangular openings somewhat larger than the cross section of the plate 78 to allow it to move to and from. The movement of the locking device 72 is effected by means of a power-generating means 82 mounted in a protective housing 97 on the lower side 73 of the bottom plate 68. The power-generating means in the example shown consists of a hydraulic cylinder attached by its rear end to two lugs 98 protruding from the pressure portion 71, and by its front, piston rod end is attached to two lugs 99 protruding from the inside of the locking device 72.

Figure 10:
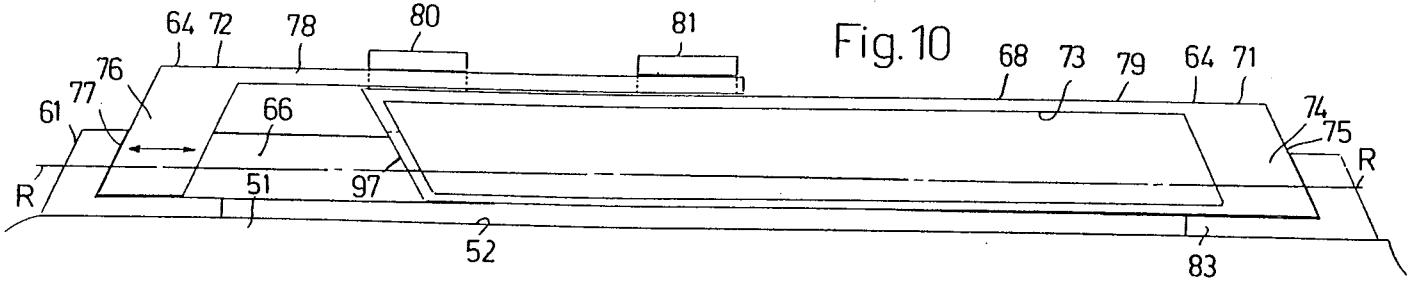
FIG. 10 shows parts of the two attachment members of the coupling means when connected together.
Figure 9:
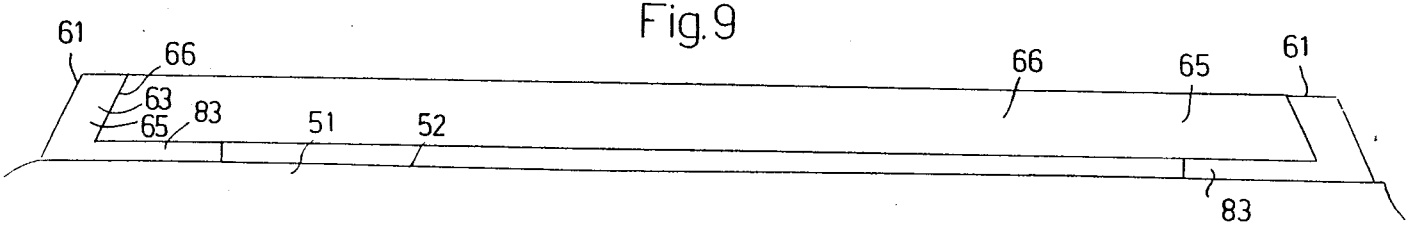
FIG. 9 is a vertical diametrical section through the bucket attachment.

In FIG. 10 a reference plane is designated with the letter R. This plane extends through the two coupling elements 63, 64 when connected, the engagement surfaces 66, 75, 77 thus being pressed together to give maximum friction. This reference plane R is thus parallel to the bottom plate 68 and said angles of inclination for the engagement surfaces 66, 75, 77 are also applicable to the reference plane R. All engagement surfaces 66, 75, 77 are arranged so that they have a circle arc-shaped extension in said reference plane and, as mentioned earlier, have the same radius. In the embodiment shown, the engagement surface 66 of coupling element 63 has maximum extension, i.e. 360°. Since the engagement surface 66 has circular extension, i.e. maximum circle arc-shaped extension, all the engagement surfaces 66, 75, 77 of the two coupling elements 63, 64 will have the same centre when the attachment members 61, 62 are connected together. By way of clarification it would be noted that said reference plane R is perpendicular to a common central plane through the stick 56 and operating cylinder 77. This central plane thus coincides with the central plane $C_F$ of the attachment member 62 or connecting element 67 (FIG. 8).

The shown attachment members 61, 62 are designed to be connected in such a manner that the bucket can assume different positions in relation to the operating arm. Since the attachment member 61 is provided with a ring 63 with circular engagement portion 65, the bucket 51 can assume an unlimited number of different positions for the coupling. Furthermore, the attachment member 61 can be mounted on the bucket without the need for accurate measurements to ensure that the engagement surfaces are aligned and located at predetermined points in relation to each other and to the side edges of the bucket.

The oblique, cooperating engagement surfaces 66, 75, 77 provide a friction joint with wedge action when the locking device 72 is brought into locking position. Inclined engagement surfaces are therefore preferred. The circular or circle arc-shaped extension of the inclined engagement surfaces 66, 75, 77 in turn ensures that a form joint is obtained, preventing the attachment members 61, 62 from being displaced laterally in relation to each other in said reference plane R and perpendicularly to said central plane $C_F$ of the attachment member 62. This form joint is thus maintained not only when the locking device 72 is in locking position but also when this has been loosened somewhat, i.e. when the locking device 72 and locking part 71 are in loose but inseparable engagement with the ring 63 of the bucket. While retaining this form joint, the bucket 51 can now be turned in relation to the stick 56 until the bucket has assumed the correct position for the work desired. This turning and re-adjustment of the bucket can also be performed during actual excavation in order to move the bucket to a new position suitable for a specific work, i.e. excavating or levelling out material in lateral direction. During this turning movement a lower corner of the bucket is brought into abutment with a suitable support on the ground.

The circle arc-shaped extension of the engagement portions 74 and 76 may vary. In general they may each encompass a sector angle of up to about 140°. However, this provides an undesired weight increase of the coupling. The wider the engagement portions, the better will be the engagement of coupling. A compromise must therefore be made. A preferred sector angle for the engagement portion 74 is about 90°-100° and for the engagement portion 76 about 30°-50°.

To prevent the coupling grip from being completely lost if a fault occurs in the hydraulic system serving the hydraulic cylinder 82, here too a suitable safety device is arranged to ensure that attachment members 61, 62 cannot become separated from each other when such a fault occurs. Such a safety device is then served by a drive system other than said hydraulic system.

A valuable effect obtained by designing all engagement surfaces with a circle arc-shaped extension in accordance with the present invention is that the total engagement area is increased and it will be greater in comparison with engagement surfaces which are parallel with each other for a given width of the quick coupling. Conversely, the width of the quick coupling can be reduced for a given engagement area.

If desired, the two locking parts 21, 22; 71, 72 may each consist of two separate or connected parts.

I claim:

1. A coupling means for detachably coupling a working implement (1) to the operating arm of an excavating machine, said implement having an upper surface facing the operating arm, said coupling means comprising a first attachment member (11) which is rigidly mounted to the upper surface of the implement (1) and comprises a coupling element (13), and a second attachment member (12) supported by the operating arm stick (6) and operating cylinder (7) via horizontal, parallel shafts (8, 9) and comprising a coupling element (15) consisting of two locking parts (21, 22) arranged movable in relation to each other to be brought into locking engagement with the coupling element (13) of the first attachment member (11) by means of a power-generating means (32), said coupling elements (13, 15) having cooperating engagement surfaces (17, 25, 27) which, when the attachment members (11, 12) are connected together, are located in a common reference plane (R) which is perpendicular to a common central plane for the stick (6) and operating cylinder (7), characterised in that all engagement surfaces (17, 25, 27) of the two coupling elements (13, 15) have a circle arc-shaped extension in said reference plane (R) and have the same radius.

2. A coupling means according to claim 1, characterised in that said engagement surfaces (17, 25, 27) are arranged in relation to each other in such a manner that they have the same centre when the attachment members (11, 12) are connected together.

3. A coupling means according to claim 1, characterised in that said second attachment member (12) comprises a connection element (47) forming a rigid body, that one locking part (21) is rigidly attached to the connection element (47) and the other locking part (22) is movably arranged in the connection element (47) as a locking device, and that the engagement surfaces (17, 25, 27) are inclined in relation to said reference plane (R).

4. A coupling means according to claim 3, characterised in that the locking device (22) is arranged to be moved between a free-running position and a locking position in a rectilinear path.

5. A coupling means according to claim 4, characterised in that the coupling element (13) of the implement comprises a circular engagement portion (16) with a circular engagement surface (17).

6. A coupling means according to claim 5, characterised in that the circular engagement surface (17) of the coupling element (13) is formed on the outside of the engagement portion (16).

7. A coupling means according to claim 5, characterised in that the circular engagement surface (66) of the coupling element (63) is formed on the inside of the engagement portion (65).

8. A coupling means according to claim 6, characterised in that the engagement surface of the coupling element (13; 63) faces towards the upper side of the implement (1; 51).

9. A coupling means according to claim 8, characterised in that the coupling element (13) is in the form of a flat ring or plate.

10. A coupling means according to claim 9, characterised in that the attachment member (11) of the implement (1) comprises a distance element (14) secured to the lower side of the ring or plate (13), by means of which the attachment member (11) is welded to the implement (1).

11. A coupling means according to any of claim 1, characterised in that the engagement surfaces (17, 25, 27) form an acute angle with said reference plane (R) of 20°-60°, the engagement surfaces of the two attachment members (11, 12) having the same angle in each individual case.

12. A coupling means according to any of claim 1, characterised in that the engagement surfaces (66, 75, 77) form an acute angle of 40°-80°, with said reference plane (R), the engagement surfaces of the two attachment members (61, 62) having the same angle in each individual case.

13. A coupling means according to any of claims 1, characterised in that the locking device (22; 72) encompasses a smaller sector angle than the stationary locking part (21; 71).

14. A coupling means according to claim 13, characterised in that the locking parts (21, 22) of the operating arm attachment member (12) encompass sector angles of approximately 90°-100° and 20°-35°, respectively.

15. A coupling means according to claim 13, characterised in that the locking parts (71, 72) of the operating arm attachment member (62) encompass sector angles of approximately 90°-100° and 30°-50°, respectively.

* * * * *